United States Patent [19]

Gunderson

[11] Patent Number: 4,971,371

[45] Date of Patent: Nov. 20, 1990

[54] DEFLECTABLE BAND LATCH

[75] Inventor: Jeffrey E. Gunderson, Cottage Grove, Wis.

[73] Assignee: Acry Fab, Inc., Sun Prairie, Wis.

[21] Appl. No.: 387,084

[22] Filed: Jul. 28, 1989

[51] Int. Cl.[5] ..... E05C 19/06

[52] U.S. Cl. ..... 292/76; 292/DIG. 38; 292/87

[58] Field of Search ..... 292/303, 299, 76, 77, 292/70, 87, 88, 89, DIG. 38; 312/138.1, 139.1

[56] References Cited

U.S. PATENT DOCUMENTS

| | | | |
|---|---|---|---|
| D. 265,867 | 8/1982 | Margulis | D3/78 |
| 948,598 | 2/1910 | Stuart . | |
| 987,894 | 3/1911 | Lee | 292/76 |
| 1,869,415 | 8/1932 | Fulton . | |
| 2,110,336 | 3/1938 | Lehman | 292/299 |
| 2,185,503 | 1/1940 | Fryer | 292/76 |
| 2,334,478 | 11/1943 | Corson, Jr. | 292/76 |
| 2,519,435 | 8/1950 | Byrd, Jr. . | |
| 2,631,912 | 3/1953 | Pryor, Jr. | 312/139.1 |
| 2,656,574 | 10/1953 | Kaufmann . | |
| 2,737,408 | 3/1956 | Sperry . | |
| 2,784,443 | 3/1957 | Von Berg . | |
| 2,846,713 | 8/1958 | Shankwiler . | |
| 3,083,046 | 3/1963 | Eberly | 292/76 |
| 3,302,965 | 2/1967 | Hasth et al. | 292/76 |
| 3,529,539 | 9/1970 | Schultz | 292/70 X |
| 3,650,464 | 3/1972 | Lewis | 292/76 X |
| 3,889,992 | 6/1975 | Shelton . | |
| 4,017,939 | 4/1977 | Schofield . | |
| 4,054,308 | 10/1977 | Prohaska | 292/DIG. 46 |
| 4,368,555 | 1/1983 | Salerno . | |
| 4,462,142 | 7/1984 | Hickling | 292/76 X |
| 4,501,378 | 2/1985 | Berfield | 292/87 |
| 4,542,924 | 9/1985 | Brown et al. . | |
| 4,544,191 | 10/1985 | Nakama . | |

FOREIGN PATENT DOCUMENTS

| | | | |
|---|---|---|---|
| 2029081 | 12/1970 | Fed. Rep. of Germany | 282/DIG. 38 |
| 68108 | 4/1944 | Norway | 292/87 |
| 116929 | 7/1946 | Norway | 292/87 |
| 8607406 | 12/1986 | PCT Int'l Appl. | 292/DIG. 38 |
| 618312 | 2/1949 | United Kingdom | 292/87 |
| 1568815 | 6/1980 | United Kingdom | 292/DIG. 38 |

*Primary Examiner*—Erik K. Nicholson
*Attorney, Agent, or Firm*—Lathrop & Clark

[57] ABSTRACT

A door latch formed of transparent elastic plastic is disclosed. The latch has an elastic plastic band with a base segment adapted for mounting on a door and a catch segment flexibly attached to the base segment and extending angularly outward therefrom to project transversely beyond the base segment. The band also has a striker segment flexibly attached to the catch segment and extending angularly outward therefrom and transversely to a position outlying the base segment, and also a return portion flexibly attaching the striker segment to the base segment. The band is adapted to flexibly deform when pressed against a door jamb to selectively engage the jamb. The latch may also have a stiffening rib of plastic material rigidly affixed to the base segment within the band to act to restrict the deflection of the band when the band is pushed against a door jamb. This latch is useful as a transparent latch for a transparent display case.

15 Claims, 2 Drawing Sheets

DEFLECTABLE BAND LATCH

BACKGROUND OF THE INVENTION

1. Field of the Invention

This invention relates generally to a latch for securing a door or the like to a frame, and more particularly to a unitary latch of flexible plastic construction for use in plastic display cases.

2. Description of the Prior Art

Display cases, for best effect, are constructed of transparent material. To the extent that the display case is transparent, the contents of the case, whether merchandise, sales samples, artworks, historical artifacts, or other display items, are more appreciably perceptible to the viewer. Display cases may be fabricated of glass, but glass has the drawback of being extremely brittle and susceptible to cracking and breaking, and accordingly display glass is normally mounted in frames of wood, metal or plastic which obstruct vision. Display cases may advantageously be constructed entirely of transparent plastic, such as acrylic or polycarbonate plastic, which is stronger and less prone to breakage than glass. Plastic may be drilled, cut, and shaped much more easily than glass, and plastic parts may be attached to other parts by means of adhesives or by solvent bonding.

Door, door knobs and hinges constructed of transparent plastic material are well known to the art. Door latches, however, tend to be either magnetic latching devices constructed of metal, or bulky and view-obstructing latches fabricated of opaque plastic.

Door latches of unitary plastic construction are well known to the art. For example, U.S. Pat. No. 4,542,924 to Brown discloses a unitary plastic latch for holding doors or windows closed. Yet the prior art latches are either bulky, and thus view-obstructive, or require mechanical manipulation to release the door, which is often not desirable for a plastic display case.

SUMMARY OF THE INVENTION

A device for latching a door against a jamb according to this invention has a looped band formed of elastic, plastic material which may be transparent. The band has a base segment adapted for mounting on a door and a catch segment flexibly attached to the base segment and extending angularly outward therefrom to project transversely beyond the base segment. The band also has a striker segment flexibly attached to the catch segment and extending angularly outward therefrom and transversely back to a position overlying the base segment, and also a return portion flexibly attaching the striker segment to the base segment. The band is adapted to flexibly deform when pressed against a door jamb to selectively engage the jamb.

The device of this invention may also include a stiffening rib of plastic material preferably having the same number of sides as the number of band segments. The stiffening rib is rigidly affixed to the base segment within the band and acts to restrict the deflection of the band when the band is pushed against a door jamb.

It is an object of the present invention to provide a door latch of unitary flexible plastic construction.

It is also an object of the present invention to provide a transparent door latch for transparent plastic cases.

It is a further object of the present invention to provide a door latch that may be solvent welded to a plastic door.

It is an additional object of the present invention to provide a door latch that is of adjustable latching strength.

It is a still further object of the present invention to provide a door latch that latches with low impact on the door jamb.

These objects and others will become apparent from the following detailed description taken in conjunction with the accompanying drawings wherein a preferred embodiment of the invention has been selected for exemplification.

DESCRIPTION OF THE PREFERRED EMBODIMENT

Figure 1:
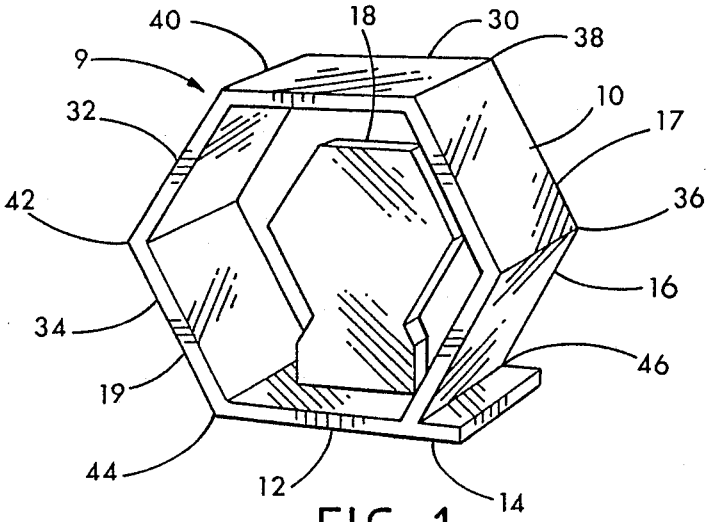
FIG. 1 is a perspective view of a door latch of this invention.

Referring more particularly to FIGS. 1–7 wherein like numerals refer to similar parts, the latch 9 includes a flexible looped band 10 preferably of hexagonal shape. The band 10 is a continuous, closed loop and is unbroken throughout its circumference. The band 10 has a base segment 12 which mounts on a door, a locator foot 14 extending transversely outwardly from the base 12, a catch segment 16 of the band extending angularly outward from the base adjacent to the foot to project transversely beyond the base and the locator foot 14, a striker segment 17 flexibly attached to the catch segment 16 and extending angularly and transversely back to a position spaced from the base segment 12, a return portion 19 of the band extending between the striker segment 17 and the base segment 12. The segments of the preferred embodiment are substantially flat in their undeformed condition. The catch and striker segments comprise inclined planes which smoothly engage the jamb during opening and closing of the door. A stiffening rib 18 etends from the base 12 within the confines of the band.

Figure 6:
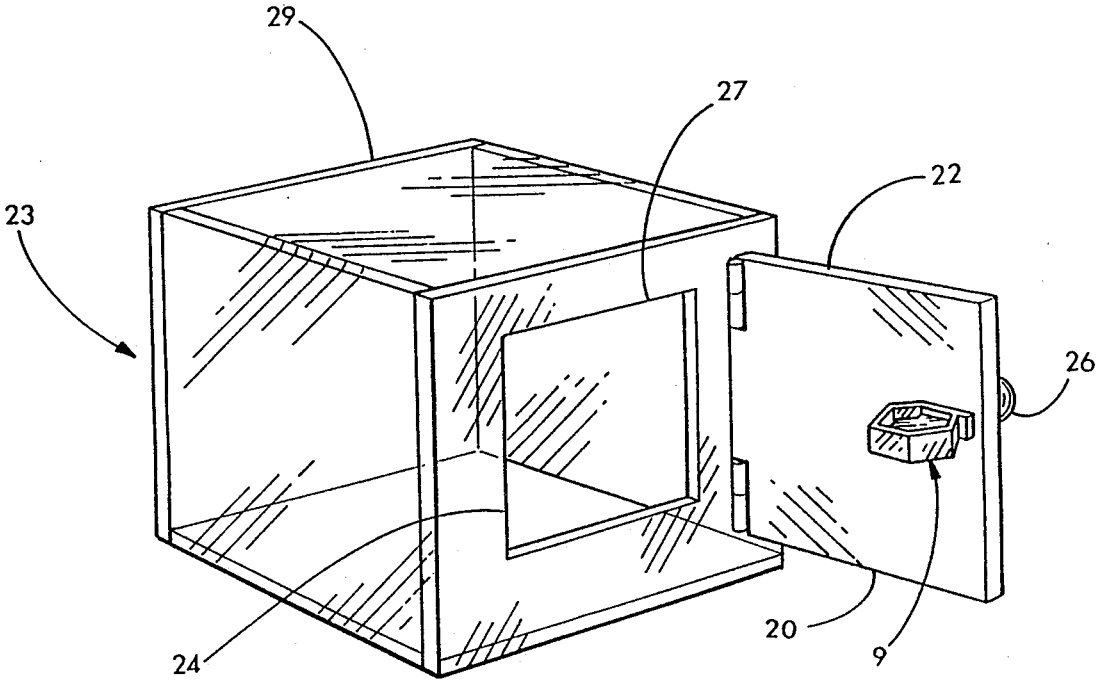
FIG. 6 is a perspective view of a door latch of this invention affixed to a display case.

The latch 9 may be constructed entirely of polycarbonate plastic material or any other transparent, suitably elastic, plastic material. As seen in FIG. 6, the latch 9 may be affixed to the jamb face 20 of a door 22 rotatably mounted as part of a display case 23 so the door may selectively cover and uncover the egress opening 27 of the display compartment 29. The latch may be affixed to the door by means of fasteners such as screws, or bolts, but it is preferably fastened, as illustrated, by solvent welding or the like so as to introduce no opaque material whatsoever into the door construction. The locator foot 14 provides a convenient reference point for locating the latch 9 on the door 22 with relation to the jamb 24.

Figure 2:
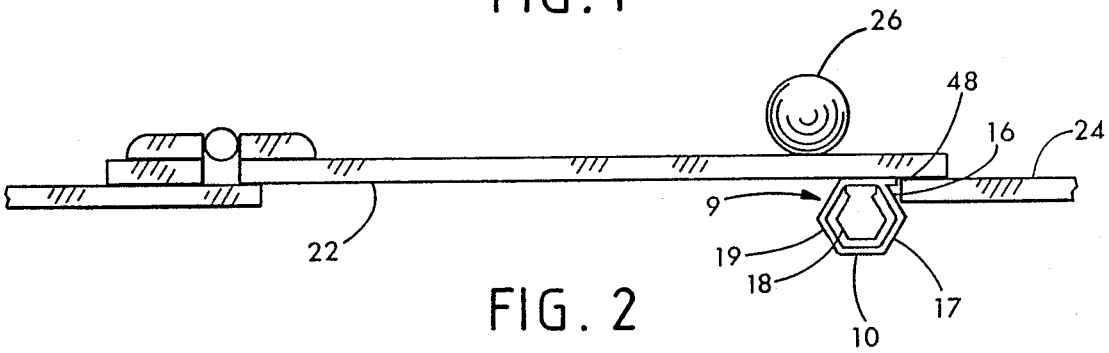
FIG. 2 is a plan view of a door latch of this invention, showing the latch affixed to a door and latching that door against a jamb.
Figure 3:
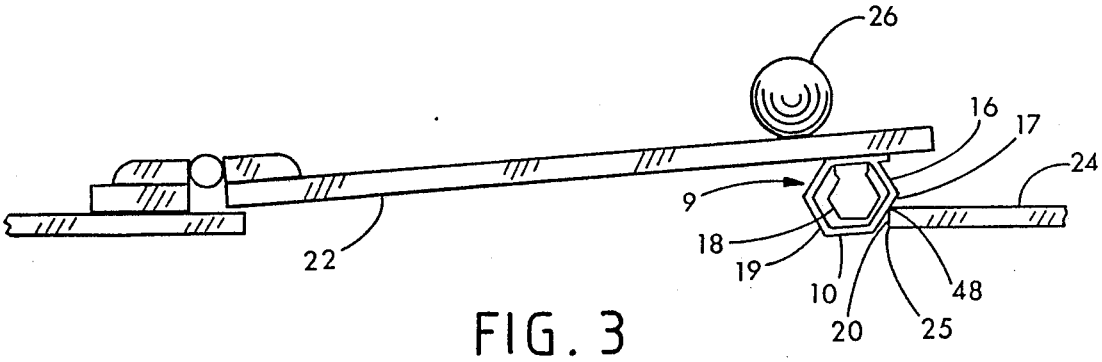
FIG. 3 is a plan view of a door with a latch of this invention in an open position.
Figure 4:
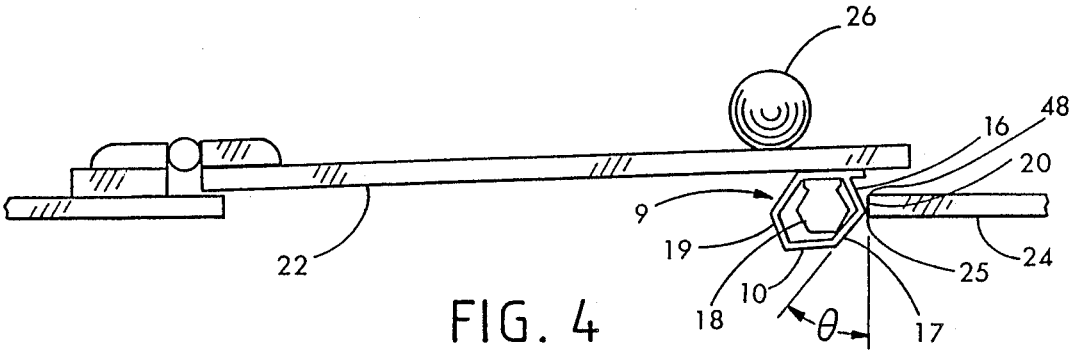
FIG. 4 is a plan view of a door with a latch of this invention in a partially closed position, showing the latch subject to maximum deflection during latching.
Figure 5:
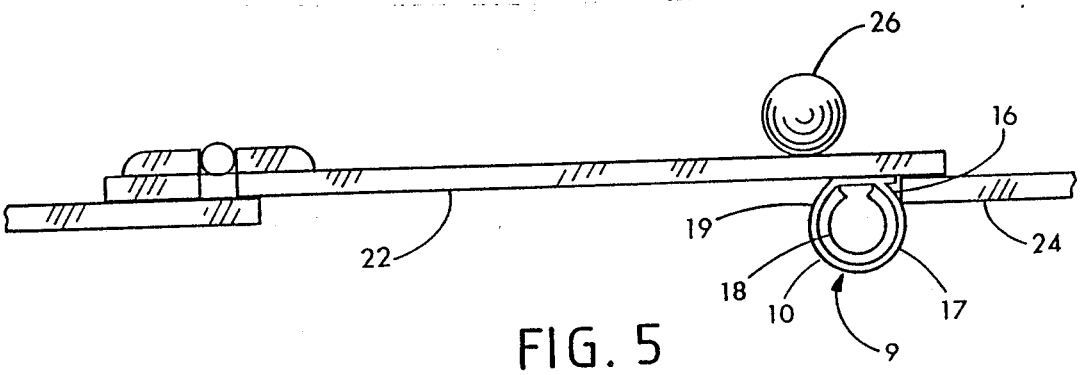
FIG. 5 is a plan view of a door latch of this invention having a circular band.

FIGS. 2–4 show the operation of the latch 9. In FIG. 3, the door is partially open, but approaching the closed position. The latch 9 is positioned against the jamb 24, with the striker portion 17 just engaging the jamb. Fig. 4 shows the door 22 and latch 9 in a partially closed position, with the flexible band 10 deformed and impressed against the jamb 24. The band 10 is deflected from its original shape to its preferred position of maximum deflection. The stiffening rib 18 within the flexible band 10 serves to restrict and prevent the band from deforming too greatly beyond the elastic limit of the plastic material and thus prevents substantial permanent deformation of the band of the latch. In FIG. 2, the door 22 is closed against the jamb 24. The band 10, now clear of the jamb 24, returns to its original undeflected shape. In this position, the catch segment 16 of the band 10 engages the rear corner 25 of the jamb 24, preventing the door 22 from opening. To release the latch 9, the user need only pull on the door knob 26, causing the catch segment 16 of the band 10 to be deflected by the resisting force exerted on it by the door jamb 24, thus allowing the catch segment to clear the jamb and the door to open.

The band return portion 19 includes three restoring segments 30, 32 and 34. The base segment 12, catch segment 16, engaging segment 17 and the three restoring segments 30, 32 and 34, are joined to one another at the ridges 36, 38, 40, 42, 44 and 46 which, because of the flexible attributes of the plastic material from which the band 10 is constructed, act as unitary hinges between these segments. Forces applied perpendicular to the face of a segment do not substantially bend the segment, but primarily instead cause the segments of the band 10 to rotate about the ridges.

In closing the door 22 with the mounted latch 9, the striker segment 17 is the first segment of the flexible band 10 to make contact with the front corner 48 of the jamb 24, as illustrated in FIG. 3. The force of closing the door 22 against the front corner 48 acts at an angle $\theta$ on the face of the striker segment 17 as shown in FIG. 4. This force may be resolved into a component force running parallel to the striker segment 17 and a component force acting perpendicular to the striker segment 17. This perpendicular component of force acts primarily to flex or rotate the catch segment about ridge 46, and the restoring segment 34 about the ridge 44, as well as flexing striker segment 17 in the opposite direction about ridge 36, and also flexing restoring segments 30 and 32 about their respective ridges 38, 40, and 42. The effect of these flexing or rotating actions is to decrease the distance by which the ridge 36 projects beyond the base segment 12 and thereby push the band 10 out of the way of the jamb 24, as in FIG. 4, until the ridge 36 passes over the jamb 24. Once the ridge 36 has passed the front corner 48 of the jamb, the ridge 36 slides unimpeded across the jamb face 20 and passes the rear corner 25 of the jamb. The catch segment 16 of the band 10 exerts a decreasing amount of force on the jamb as the door 22 travels toward the plane of the jamb 24. As the force exerted against the catch segment 16 is reduced, the angular displacement of segments 16, 17, 30, 32, and 34 about the ridges 36, 38, 40, 42, 44 and 46 is also reduced, until the closure point is reached where the band 10 substantially resumes its original shape. The door 22 is then in a fully latched position, as shown in FIG. 2, with the catch segment 16 closely engaged against the rear corner 25 of the jamb 24 to retain the door 22 against the jamb.

The catch segment 16 in the fully latched position can be seen to project beyond the jamb 24. Any minimal forces, such as jostling of the display case, air currents, or vibrations will be resisted by the elastic force of the band 10. In this way the latch 9 keeps the door closed.

To open the door 22, a pulling force is exerted on the knob 26 which results in a force being applied to the base of the catch segment 16 by the rear corner 25 of the jamb 24, that force causing the catch segment 16, the engaging segment 17 and the restoring segments 30, 32 and 34 to rotate about the ridges 36, 38, 40, 42, 44 and 46 to allow the latch 9 to clear the jamb 24.

Due to the angle at which the jamb 24 engages catch segment 16, it is only necessary to apply a small force over the length of the catch segment 16 in order to deform the band 10 sufficiently to unlatch the door. In both the opening and closing of the door 22, the stiffening rib 18 acts to prevent plastic deformation of the band 10 which might otherwise prevent the complete elastic restoration of the band 10 to its original shape. The stiffening rib 18 particularly protects the band 10 against excessive deformation if subjected to an external force, such as a blow from a foreign object or excessive squeezing.

Because of the gradually deforming action of the flexible band 10 of the latch 9, the latching or unlatching operation takes place over the entire length of the catch segment 16 or the engaging segment 17. This gradual action means that a much less intense force need be applied to the door jamb by the door. The jamb 24 engages both the catch segment 16 and the striker segment 17 substantially at the angle $\theta$, which for a band 10 of the preferred hexagonal shape will be of approximately 30°. Such a band configuration results in a larger proportion of the opening and closing force applied to the door being directed to displacement of the latch band than to resistance of door movement. Accordingly, the latch will cushion closure of the door without "bounce", and will retain the door snugly in the latched position without requiring an excessive force to overcome the latch and open the door. Therefore, the contents of a display case to which a door equipped with this latch is attached will be less disturbed by the opening and closing of the door.

If a latch with user variable latching strength is desired, then the latch may be fabricated of a plastic material having elastic and plastic properties which permit the permanent deformation of the band by application of hand pressure.

If a greater or lesser latching strength is desired, the user adjusts the incline of the catch and engagement segments 16 and 17 by grasping the flexible band 10 between his fingers and pressing it either away from the locator foot 14, if less latching force is desired, or towards the foot if a greater latching force is desired.

When this latch is used on a transparent display case, the transparent plastic of the latch will not display case.

Figure 7:
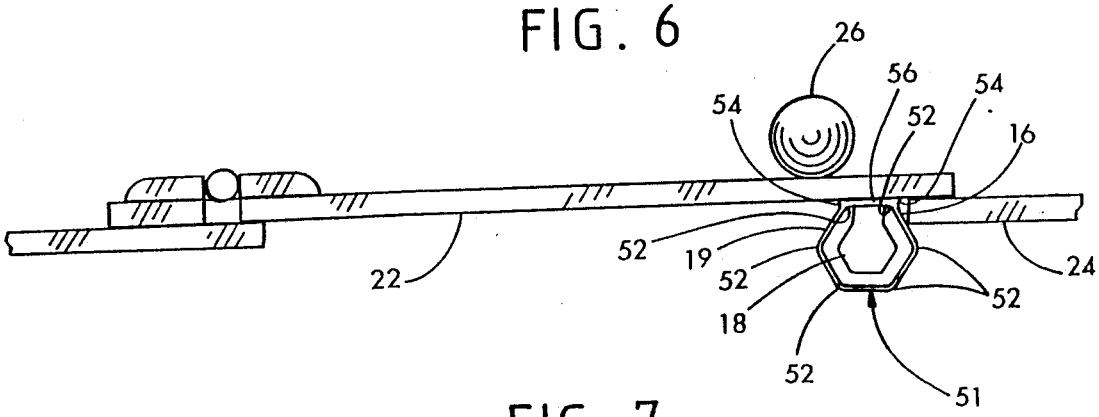
FIG. 7 is a plan view of a door latch of this invention having a band with radiused ridges and symmetrical locating feet.

Another preferred embodiment of the invention is the latch 51 illustrated in FIG. 7. In the latch 51, the segments of the flexible band meet at radiused ridges 52 to form a band without sharp edges. The latch 51 also has symmetrical locating feet 54 which are radiused extensions from the base segment 56 which provide a convenient reference point for locating the latch 51 on the door 22 with relation to the jamb 24.

It should be understood that the six-sided flexible band 10 illustrated and described is the preferred shape, and that bands of five or more segments may also be constructed according to this invention. It should also be understood that more than one latch may be affixed to a single door on one or more sides of that door to come in contact with one or more faces of a door jamb. The latch may also be used on windows, hatchcovers, or entryways equally as well as doors. Also, the thickness and dimensions of the segments of the flexible band may be varied to achieve differing latching strengths and closing properties. The latch is preferably constructed in one piece by an injection molding process, but may equally well be constructed of a number of pieces or by heat forming or machining.

It should be understood that this invention is not limited to the particular construction and arrangement of parts herein illustrated and described, but embodies all such modified forms thereof as come within the scope of the following claims.

What is claimed is:

1. A device for latching a door against a jamb, comprising:

(a) a looped continuous and closed band formed of elastic, plastic material, the band having a base segment adapted for mounting on the door, a catch segment flexibly attached to the base segment and extending angularly outwardly thereform to project transversely beyond the base segment, a striker segment flexibly attached to the catch segment and extending angularly therefrom and transversely back to a position spaced from the base segment, and a return portion flexibly attaching the striker segment to the base segment, wherein the band is flexible so that the band will deform upon the engagement of the striker segment with the jamb and permit the band to cushion the closing of the door and permit the band to pass over the jamb, and the catch segment will engage the jamb and retain the closed door against the jamb but the band will deform when an opening force is applied to the door to permit the band to pass back over the jamb and the door to be opened; and (b) a stiffening rib of plastic material rigidly affixed to the base segment and extending therefrom within the confines of the band and spaced therefrom to restrict the deflection of the band.

2. The device of claim 1 wherein the band has six segments of substantially the same size forming a regular hexagon.

3. The device of claim 1 wherein the device is affixed to a door by adhesive means.

4. The device of claim 3 wherein the adhesive means is solvent welding.

5. The device of claim 1 wherein the plastic material is a polycarbonate.

6. The device of claim 1 further comprising a locating foot extending transversely outwardly from the base segment to provide a reference point from which to determine placement of the device on a door.

7. The device of claim 1 wherein the plastic material is substantially transparent.

8. The device of claim 1 wherein the looped band is substantially circular and the catch and striker segments are substantially segments of a circle.

9. The device of claim 1 wherein the plastic material of the flexible band is adapted to permit permanent deformation of the band by application of hand pressure to adjust the engaging strength of the latch against the jamb.

10. A display case comprising:

(a) a transparent display compartment having portions defining a door jamb around an egress opening;

(b) a transparent plastic door rotatably mounted on the display compartment to selectively cover and uncover the egress opening;

(c) a latch comprising a looped continuous and closed band formed of transparent elastic plastic material, the band having a base segment mounted on the door, a catch segment flexibly attached to the base segment and extending angularly outwardly therefrom to project transversely beyond the base segment, a striker segment flexibly attached to the catch segment and extending angularly therefrom and transversely back to a position spaced from the base segment and a return portion flexibly attaching the striker segment to the base segment, wherein the band is flexible so that the band will deform upon the engagement of the striker segment with the jamb to cushion the closing of the door and permit the band to pass over the jamb, and the catch segment will engage the jamb and retain the closed door against the jamb but the band will deform when an opening force is applied to the door to permit the band to pass back over the jamb and the door to be opened; and (d) a stiffening rib of plastic material rigidly affixed to the base segment of the latch and extending therefrom within the confines of the band and spaced therefrom to restrict the deflection of the band.

11. The display case of claim 10 wherein the band of the latch has 6 segments of substantially the same size forming a regular hexagon.

12. The display case of claim 10 wherein the latch is affixed to the door by solvent welding.

13. The display case of claim 10 wherein the band of the latch is substantially circular and the catch and the striker segments are substantially segments of a circle.

14. The display case of claim 10 wherein the plastic material of the flexible band of the latch is adapted to permit permanent deformation of the band by application of hand pressure to adjust the engaging strength of the latch against the jamb.

15. A device for latching a door against a jamb, comprising:

a looped continuous and closed band formed of elastic, plastic material, the band having a base segment adapted for mounting on the door, a catch segment flexibly attached to the base segment and extending angularly outwardly therefrom to project transversely beyond the base segment, a striker segment flexibly attached to the catch segment and extending angularly therefrom and transversely back to a position spaced from the base segment, and a return portion flexibly attaching the striker segment to the base segment wherein each is substantially flat and adjoins the adjacent segment to from a ridge which acts as unitary hinge between segments so that forces applied to the segments of the band will primarily cause the segments to rotate about the ridges, wherein the return portion has three segments so that the band has six segments of substantially the same size forming a regular hexagon; and wherein the band is flexible so that the band will deform upon the engagement of the striker segment with the jamb and permit the band to cushion the closing of the door and permit the band to pass over the jamb, and the catch segment will engage the jamb and retain the closed door against the jamb but the band will deform when an opening force is applied to the door to permit the band to pass back over the jamb and the door to be opened, the catch and striker segments between the ridges comprising inclined planes which smoothly engage the jamb during opening and closing of the door.

* * * * *